US005653502A

United States Patent [19]

Kimura et al.

[11] Patent Number: 5,653,502

[45] Date of Patent: Aug. 5, 1997

[54] FOLDABLE CHAIR

[75] Inventors: Teruyuki Kimura; Yasuhisa Matsuo; Fumihiko Ueda, all of Osaka, Japan

[73] Assignee: Kokuyo Co., Ltd., Osaka, Japan

[21] Appl. No.: 553,498

[22] PCT Filed: Mar. 31, 1995

[86] PCT No.: PCT/JP95/00636

§ 371 Date: Mar. 25, 1996

§ 102(e) Date: Mar. 25, 1996

[87] PCT Pub. No.: WO95/30813

PCT Pub. Date: Nov. 16, 1995

[30] Foreign Application Priority Data

May 6, 1994 [JP] Japan ..... 6-094461

[51] Int. Cl.[6] ..... A47C 4/00

[52] U.S. Cl. ..... 297/217.7; 297/232; 297/331; 297/335; 297/15; 52/9

[58] Field of Search ..... 297/232, 331–332, 297/334, 335, 336, 217.7, 257, 15; 52/7–9, 10

[56] References Cited

U.S. PATENT DOCUMENTS

| | | | |
|---|---|---|---|
| 3,443,835 | 5/1969 | Brunskole | 52/9 |
| 3,703,312 | 11/1972 | Chapman | 297/331 |
| 3,792,904 | 2/1974 | Mackintosh | 297/331 |
| 4,000,486 | 12/1976 | Vance et al. | 52/9 |
| 4,557,080 | 12/1985 | Walworth et al. | 297/332 |
| 5,245,799 | 9/1993 | Sugiyama | 297/331 |
| 5,328,238 | 7/1994 | Yamazaki | 297/332 |

FOREIGN PATENT DOCUMENTS

| | | |
|---|---|---|
| 1-26843 | 8/1989 | Japan . |
| 1-42614 | 12/1989 | Japan . |
| 4-64386 | 10/1992 | Japan . |

*Primary Examiner*—Peter R. Brown
*Assistant Examiner*—Anthony D. Barfield
*Attorney, Agent, or Firm*—Banner & Witcoff, Ltd.

[57] ABSTRACT

Disclosed is a foldable chair of the type which is capable of being folded or collapsed into a compact configuration when not in use, while at the same time, is capable of giving a weighty and sturdy appearance when in use, for example, on a movable bleacher stand. The chair 7 comprises a support base 8 to be installed on a floor 2, a pair of legs each comprising a first link member 9 pivotally mounted for a to-and-fro swing motion with respect to the support base 8 and a second link member 11 pivotally mounted behind the first link member 9 essentially in parallel therewith for a to-and-fro swing motion with respect to the support base 8, an armrest 12 pivotally connected to the upper ends of the first and second link members, a seat 13 supported at each of its lateral sides by the first link member 9, and a backrest 14 pivotally supported at each of its opposite lateral sides by the second link member 11.

3 Claims, 9 Drawing Sheets

FOLDABLE CHAIR

FIELD OF THE ART

This invention relates generally to foldable chairs and, more particularly, to a new and improved foldable chair of the type and construction suitable for use on a movable bleacher stand or the like.

BACKGROUND ART

Various types of movable bleacher stands have been developed of late for installation in a multi-purpose hall or gymnasium. A typical movable bleacher stand includes a plurality of retractable multi-stepped stand sections, both sides of which are supported by movable frees. When the bleacher stand is not used, the movable support frames are usually kept in their retracted positions, where the plurality of stepped stand sections are held stacked or nested on one another in a relatively small overall configuration, thereby clearing the floor. In order to use the bleacher stand, the movable support frees are advanced to extend the stand sections into a multi-stepped configuration. For this purpose, the chairs to be installed on the stepped floor sections are conventionally of such design that they tilt down and lie flat on the floor surface for storage when not in use. Typically, in the prior-art bleacher stand, a plurality of support blocks are located spaced apart side by side on the support base, and one or more elongated support beams are placed transversely on these blocks. Mounted upright on the support beams in a spaced-apart relationship are a plurality of support legs of the chairs, upon the upper ends of which armrests are mounted. Seats and backrests extend or span between two adjacent support posts. In order to store the chairs, the support blocks together .with the support beam are tilted forward, causing the support legs, seats, backrests and armrests to be stacked flat one upon another on the floor.

With this type of collapsible chairs, it is essential to reduce the collapsed configuration of each chair to a minimum for space economy. In order to meet this requirement, it has conventionally been attempted to use thinner support blocks and legs. However, with these chairs, it is difficult to meet the demand, for example, of a theater where chairs weighty and sturdy in appearance are needed.

Moreover, in the conventional arrangement where the support blocks, beams and legs are simply designed to be tilted, it is necessary to .employ short armrests. Otherwise, they extend outwardly beyond the front edge of the floor section when the chair is collapsed flat. The short armrests are not sufficiently comfortable to rest our arms on, while, at the same time, they lack a weighty appearance.

These problems are not limited to the prior-art chairs to be installed on the multi-stage, stepped movable bleacher stand, but also are found in those chairs for use on a single-stage, flat movable bleacher stand, which is designed to be retracted under the stage of a hall or gymnasium for storage.

A bleacher stand of a different design has been developed wherein foldable chairs are mounted on a lift mechanism that moves up and down between upper and lower positions. When it is intended to use the chairs, the lift mechanism remains in the upper position to hold the chairs out on the floor, and when not in use, the mechanism is retracted down to the lower position to keep the chairs stored under the floor. However, with this type of bleacher stand, it is impossible to employ chairs weighty in appearance and sturdy in construction since the storage opening made in the floor must be kept at a minimum size.

It is an object of the invention to provide a new and improved foldable chair which is capable of overcoming these and other problems.

DISCLOSURE OF THE INVENTION

In order to achieve this object, a preferred embodiment of the foldable chair of the present invention comprises a support base, a pair of first link members pivotally movable with respect to the base member, a second pair of link members mounted behind and in parallel to the first link members for pivotal movement with respect to the base member, a pair of armrests pivotally mounted to the upper ends of the first and second link members, a seat pivotally supported by the pair of first link members, and a backrest supported by the pair of second link members.

When it is intended to install the foldable chair of the invention on a single-stage, flat movable bleacher stand or a multi-stage, stepped movable bleacher stand, the support base is preferably mounted on the flat floor or floor section, while the first and second pairs of link members are mounted for pivotal movement between an extended position where the chair stands upright on the floor for use, and a folded position where the chair is folded flat on the floor for storage.

When it is contemplated to install the foldable chair of the invention on a bleacher stand of the underfloor storage type, the support base is preferably mounted on a lift mechanism which moves between an upper position where the chair is extended out on the floor for use, and a lower position where the chair is retracted under the floor for storage. The relative vertical positions of the lower pivot point of the first link member and the lower pivot point of the second link member are variable.

The pair of support legs variable in width may be formed solely by the first and second pairs of link members, or alternatively, they may be formed by the first and second pairs of thin link members and an intermediate member that connects the link members together, thereby giving them a weighty and sturdy appearance.

With this arrangement of the foldable chair, the first and second link members are pivotally connected by means of the armrest to form a dual linkage of equal or unequal length, so that the support legs of the chair formed by the first and second pairs of link members are variable in width. As the first and second link members are pivoted forward, both the link members move closer toward the floor while moving closer to each other until finally they lie flat on the floor in a telescopically nested relationship. Thus the foldable chair of the present invention has support legs of bulky configuration in its extended, for-use position, while in its folded position, the chair assumes a relatively small overall configuration.

In the arrangement of the foldable chair where it is mounted on a lift mechanism, either the upward movement of the lower pivot point of the first link member, or the downward movement of the lower pivot point of the second link member, or the combined movement of both causes the armrest to be displaced upright and the first and second link members to be brought closer together, leading to a compact overall configuration of the folded chair. If it is intended to bring down the chair into a storage space under the floor by means of the lift mechanism after the chair has been folded compactly in this manner, the access opening to the storage space can be made smaller in size. In short, although the foldable chair of the invention has a pair of rather bulky support legs in use, it does not require an excessively large access opening leading to the storage space under the floor.

As explained in brief hereinabove, the fact that the support legs of the foldable chair according to the invention consist of the first and second link members, which together form a dual linkage, is instrumental in achieving a bulky configuration of the support legs when the chair is in use, while, at the same time, bringing about a comparatively small overall configuration of the chair when folded for storage. Thus, the foldable chair has been provided having a weighty and luxurious appearance as well as much improved stability.

BEST MODES OF EMBODYING THE INVENTION

Now referring to FIGS. 1 to 6, one preferred embodiment of the invention will be described in detail.

Figure 1:
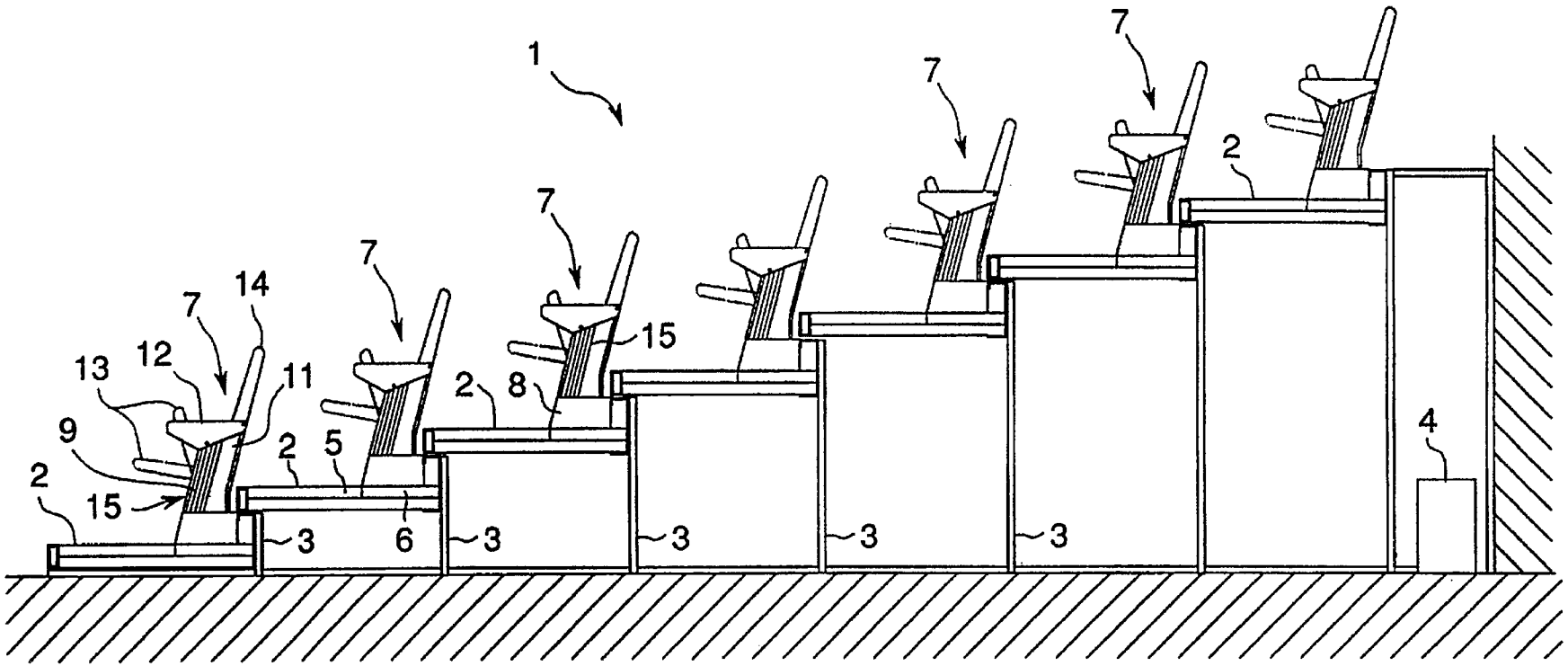
FIG. 1 a schematic view in elevation showing a plurality of new and improved chairs according to one preferred embodiment of the invention as installed on a stepped bleacher stand.
Figure 2:
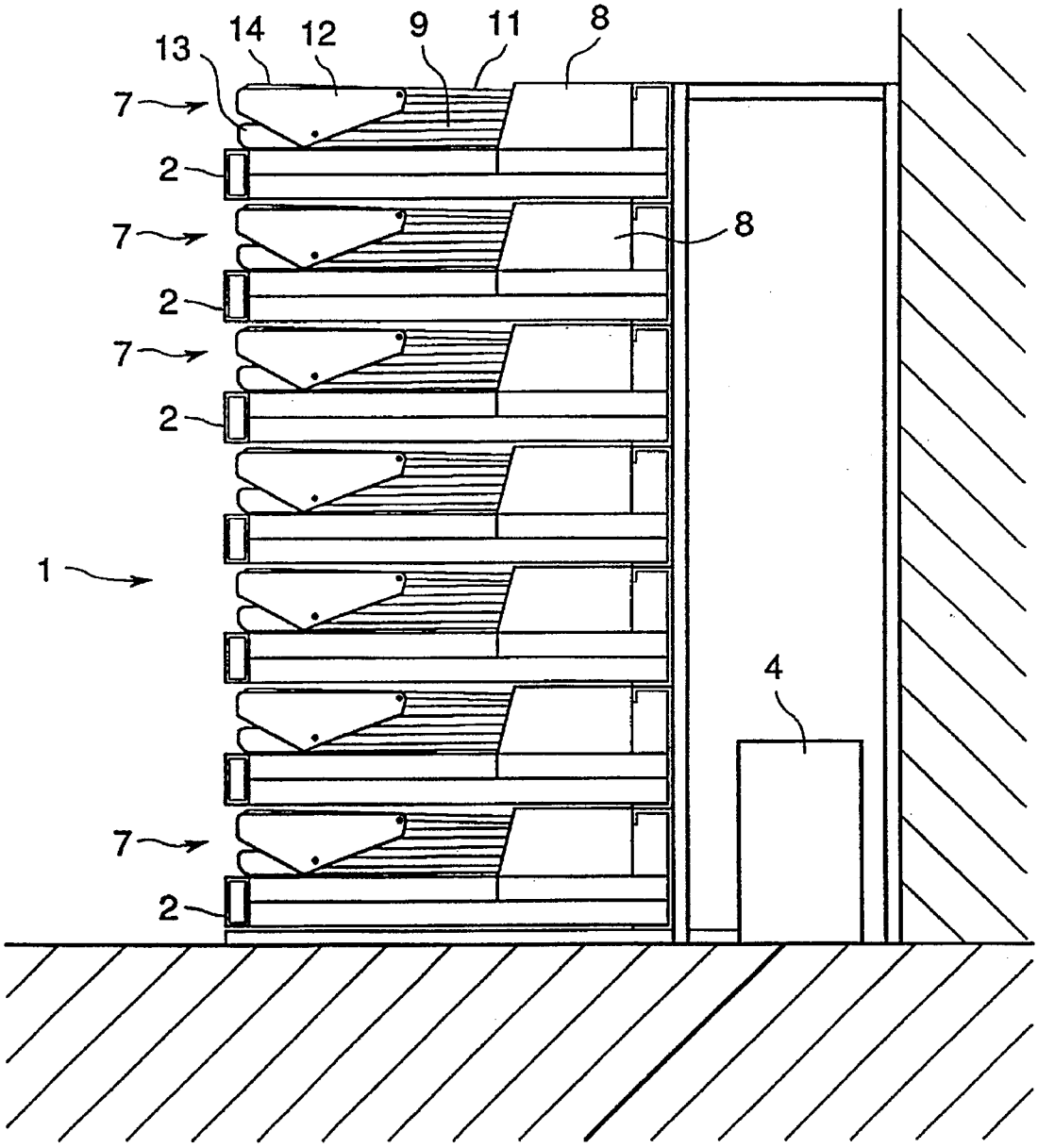
FIG. 2 is a schematic view in elevation showing the chairs of FIG. 1 stacked on one another in the retracted storage position of the bleacher stand.

It is noted that, in the illustrated embodiment, the present invention has been applied to a multi-stage, stepped bleacher stand that is movable on the floor or otherwise flat supporting surface. The movable multi-stage, stepped bleacher stand 1 has a plurality of stand sections 2, and is designed to be movable between an extended stepped position for use as shown in FIG. 1 and a retracted stacked position for storage as shown in FIG. 2. The support frame 3 for movably supporting each stand section 2, and the drive mechanism 4 for driving the movable support frames 3 between their extended and retracted positions are well-known in the art and, therefore, no detail description thereof is given here.

Each stand section 2 includes a floor panel 5 and a unit frame 6 located in the front and rear half portions, respectively. Disposed on each unit frame 6 is a unique chair 7 of foldable or collapsible construction according to the invention.

As shown, the foldable chair 7 comprises a supporting base 8 fixedly attached to the unit frame 6, a pair of legs each comprising a first link member 9 pivotally mounted for forward and rearward swing motion with respect to the support base 8 and a second link member 11 mounted behind the first link 9 generally in parallel thereto for forward and rearward pivotal movement with respect to the support base 8, an armrest 12 pivotally connected to the upper ends of the first and second link members 9 and 11, a seat 13 pivotally supported by the first link member 9, and a backrest 14 supported by the second link member 11.

Figure 5:
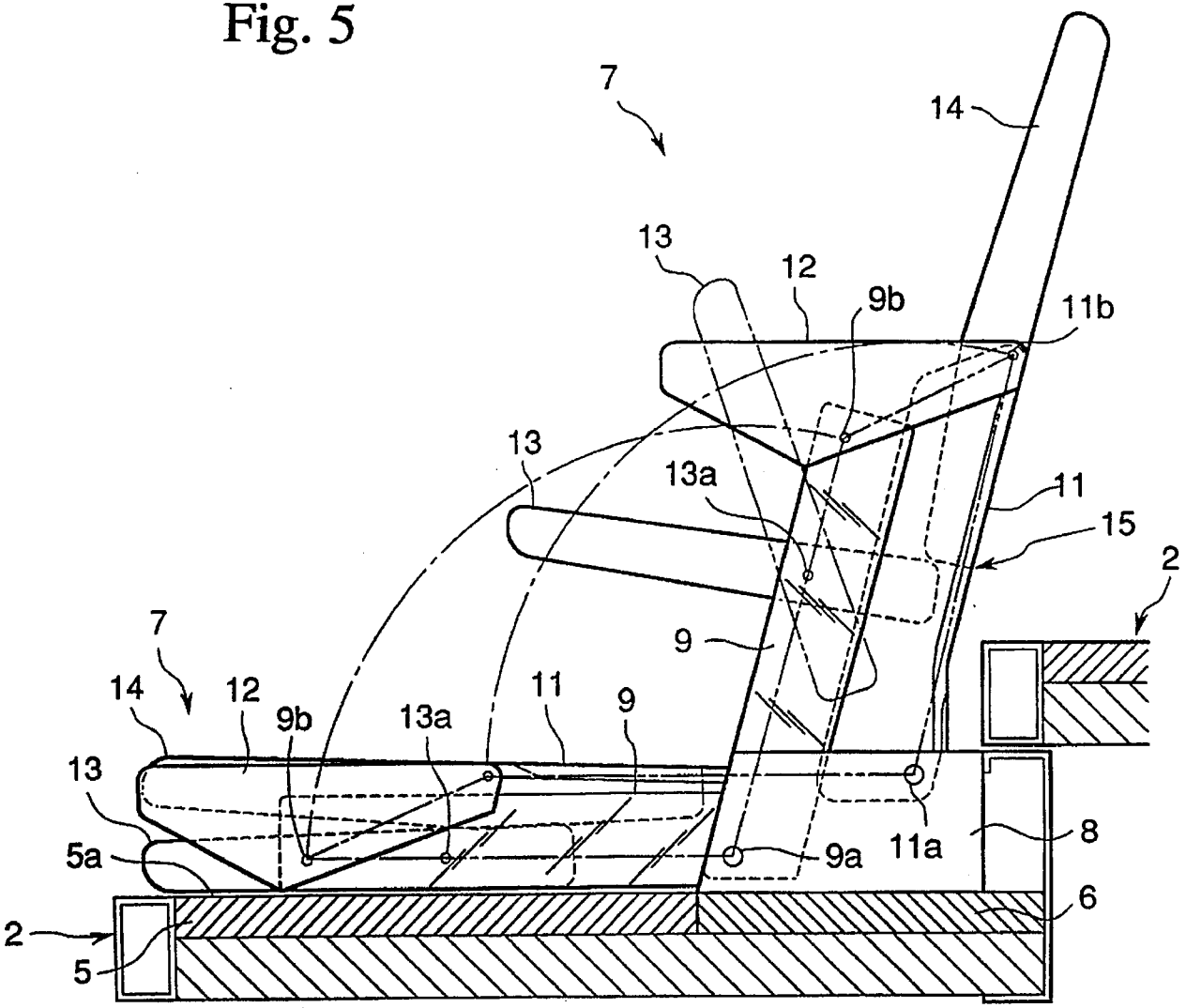
FIG. 5 is an enlarged elevational view similar to FIG. 3, showing the chair extended and folded.
Figure 6:
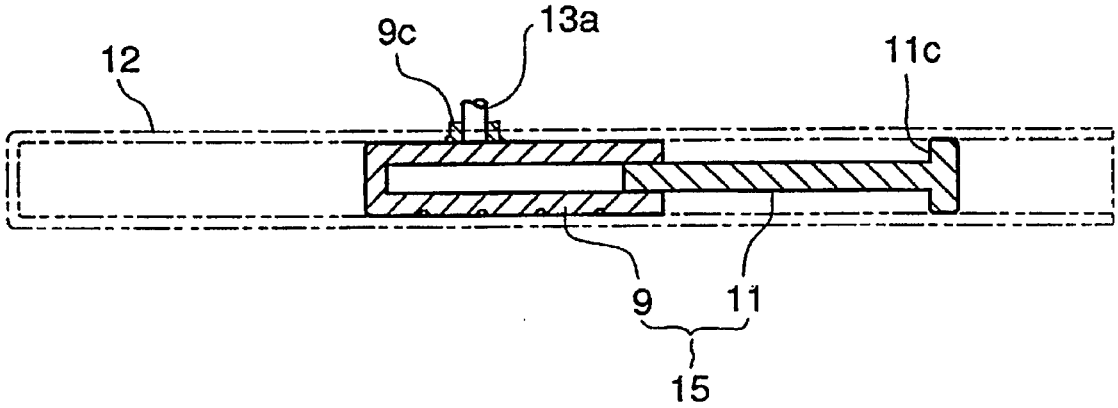
FIG. 6 is a horizontal cross-sectional view taken along line 6—6 in FIG. 3.

More specifically, the first link member 9 is in the form of a flat rectangular hollow post with one narrower side removed for the purpose hereinbelow explained, giving it a U-shaped horizontal cross section as shown in FIG. 6. The first link member 9 has its lower end pivotally connected to the support base 8 by means of an axle or shaft 9*a* for to-and-fro swing motion between its generally upright position for use and its horizontal position for stacked storage (see FIG. 5). The second link member 11 is in the form of a flat plate having a longitudinal rib 11*c* integrally made along its rear edge, and has its front edge slidably inserted within the first link member 9 through its open side. Thus, the first and second link members 9 and 11 together form a support leg 15 of the foldable chair. As in the case of the first link member 9, the second link member 11 also has its lower end pivotally connected to the support base 8 by means of an axle 11*a*.

The armrest 12 comprises a hollow box-like member with its lower and rear sidewalls removed. The armrest 12 is snugly fitted over the upper ends of the first and second link members 9 and 11. It is also pivotally mounted at its middle portion to the upper end of the first link member 9 by means of an axle 9*b*, and at its rear portion to the upper end of the second link member 11 by means of an axle 11*b*.

Figure 3:
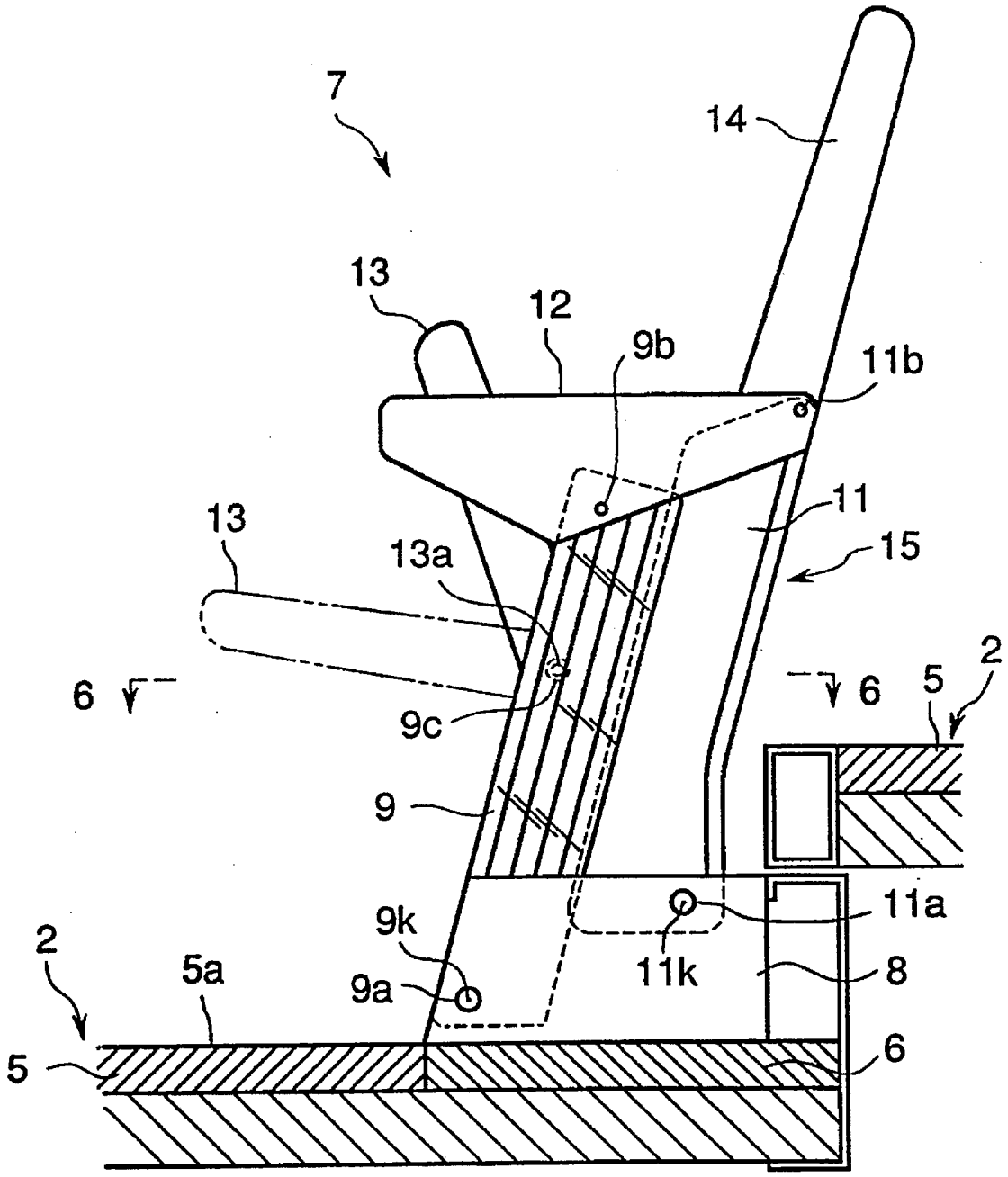
FIG. 3 is an enlarged elevational view, partly in section, of one of the chairs shown in FIG. 1.

The seat 13 is provided between a pair of support legs 15 and has its rear portion pivotally mounted to the first link member 9 by means of an axle 13*a*, which snugly fits into a bearing support 9*c* provided at the inner face of the first link member 9. The arrangement for pivotally mounting the seat 13 is essentially similar to those of the prior-art and, therefore, no further description is given here. Suitable spring means (not shown) is employed to normally force the seat 13 upwardly into a generally upright unseating position as shown in FIG. 3. When pushed or pulled down, the seat 13 pivots down toward its horizontal seating position as shown in imaginary lines in FIG. 3. It should be noted that the seat 13 in its upright unseating position can be pivoted further back into a fully folded position by pushing it backward, where the seat 13 is nested onto the backrest 14.

The backrest 14 also extends between the pair of supporting legs 15 and is fixedly mounted to the pair of second link members 11.

The manipulation of the above described chair mechanism is now explained with reference to the drawings.

FIGS. 1 and 3 shows the multi-stage bleacher stand 1 in its fully extended state for use, with the first and second link members 9 and 11 standing generally upright in parallel to each other. In this positional condition, the support leg 15 formed by the first and second link members takes on an extended front-to-rear configuration, which in turn gives individual chairs a weighty and sturdy appearance.

Figure 4:
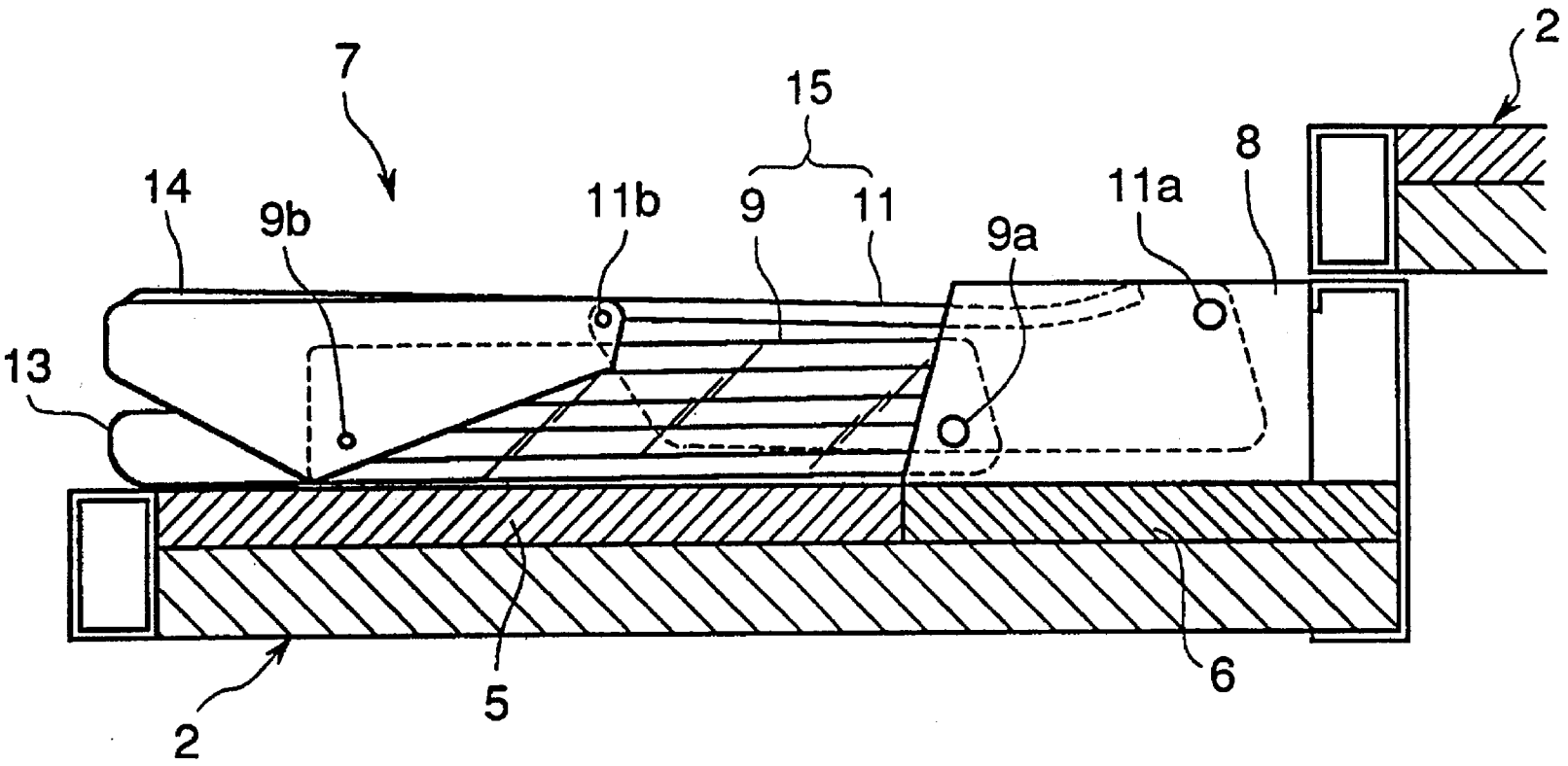
FIG. 4 is an enlarged elevational view similar to FIG. 3, showing the chair in its compactly folded position.

In order to retract the stand sections 2 of the multi-stage bleacher stand into the storage position, the first and second link members 9 and 11 of each chair 7 are pivoted forward down onto the floor panel 5. During this forward pivotal movement, the first and second link members move together keeping their parallel relationship with respect to each other, and when they lie flat on the floor surface 5*a*, the second link member 11 is fitted deep within the first link member 9 in a telescoping manner so that the support leg 15 as a whole is collapsed into a compact size. It should be noted that the support leg 15, which assumes the weighty and sturdy configuration in use, can be folded into a relatively small overall configuration for storage. As clearly shown in FIGS. 2 and 4, in the lying-flat or folded position of the chairs 7, the backrest 14 is nested onto the seat 13, while the support leg 15 is reduced in lateral size, leading to a minimum possible configuration of the whole chair. With this configuration of the chairs 7, each of the movable stage sections 2 is retracted into the stacked storage position as shown in FIG. 2, where one folded chair 7 lies subjacent to another chair 7 in a nested relationship. The armrest 12, which forms together with the first and second link members 9 and 11 a differential dual linkage, lies flush with each link member in the folded position of the chair as best shown in FIGS. 4 and 5.

Figure 7:
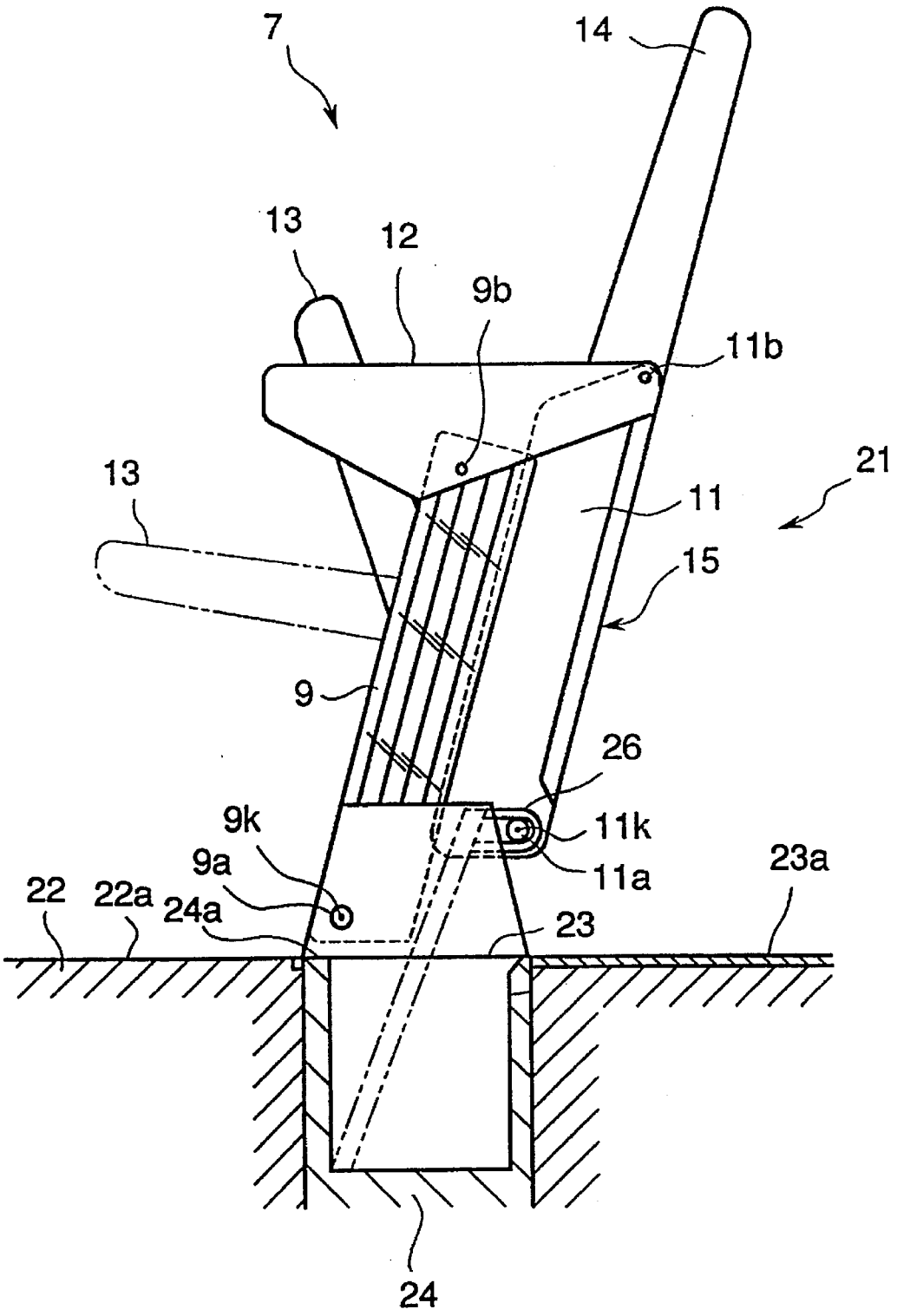
FIG. 7 is an enlarged elevational view similar to FIG. 3, showing a new and improved chair according to another preferred embodiment of the invention.
Figure 8:
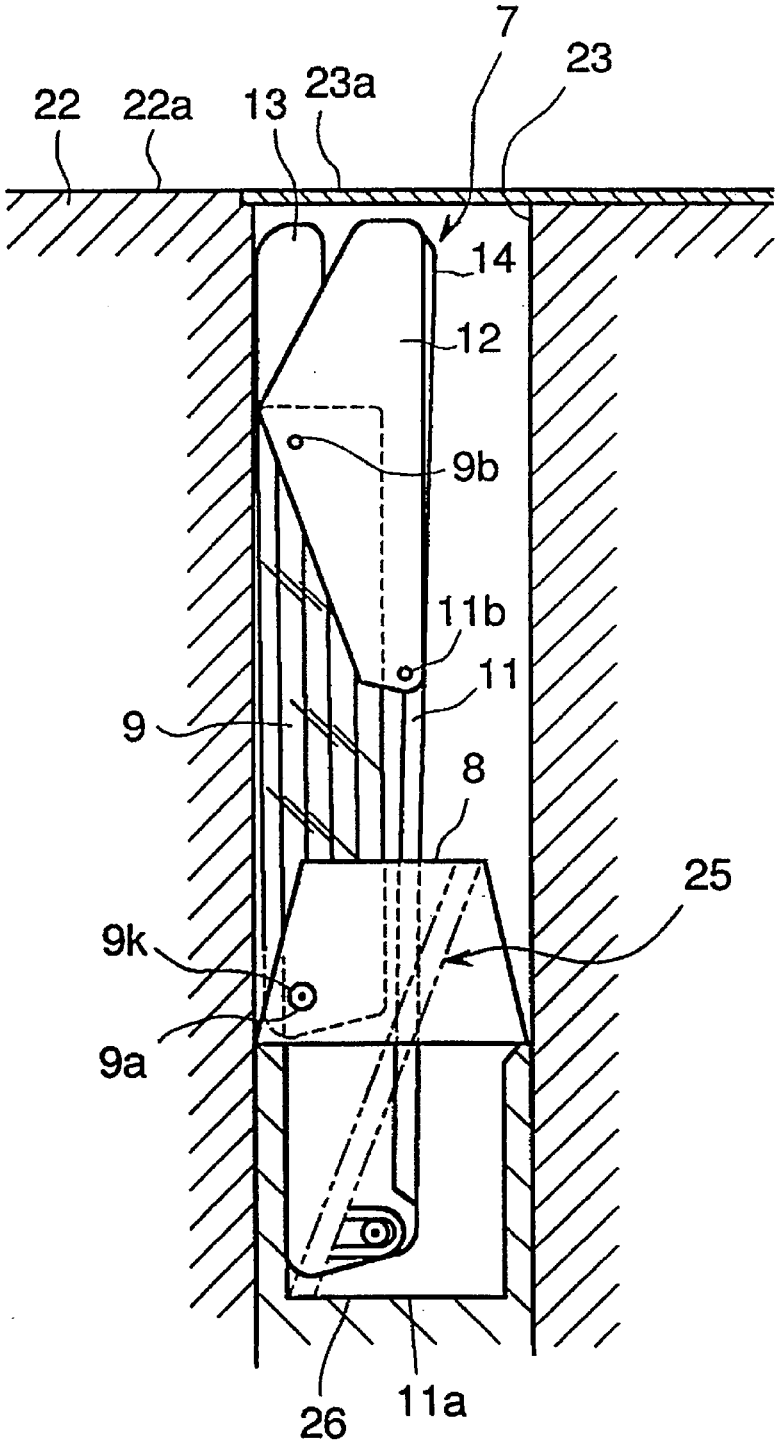
FIG. 8 is an enlarged elevational view similar to FIG. 7, showing the compactly folded chair kept in a storage space in the floor.

The present invention is not limited to the above described embodiment but may be applied with equal utility to a single stage movable bleacher stand where a plurality of foldable chairs are installed on a movable flat floor structure which can be retracted into a storage space provided under the stage of a hall or gymnasium. Alternatively, this invention is advantageously applicable to a bleacher stand where the chairs are to be retracted down into a storage space or recess provided in the floor as schematically illustrated in FIGS. 7 and 8. With this underfloor storage type bleacher stand 21, there is provided a storage recess 23 under the floor 22. The storage recess houses a lift 24 on which the chair 7 of the invention is mounted. A drive mechanism not shown moves the chair lift 24 up and down between an uppermost position (FIG. 7) and a lowermost position (FIG. 8). In the uppermost position, the top face 24*a* of the lift 24 is essentially flush with the floor surface 22*a*, and the chair 7 mounted on the lift is held out of the storage recess 23 for the intended use, while in the lowermost position, the lift 24 is fully retracted into the storage recess together with the chair. The chair 7 itself is similar in construction to the one explained in detail hereinabove in connection to the preferred embodiment of the invention and, therefore, like or corresponding parts are designated by like reference numerals. The chair 7 differs from that of the previous embodiment in that an axle 11*a* which acts as the lower pivot point 11*k* for the second link member 11 is supported by the support base 8 via an axle drive mechanism 25. The axle drive mechanism 25 includes a lift bracket 26 for supporting the axle 11*a*. The bracket 26 is designed to be moved up and down by drive means such as a screw feed mechanism, linkage mechanism or hydraulic cylinder (not shown) to be housed within the body 27.

With this arrangement, when the axle drive mechanism 25 is actuated while the chair 7 is in its extended position for use as shown in FIG. 7, the lower pivot 11*k* of the second link member 11 is brought down with respect to the lower pivot 9*k* of the first link member 9, causing the armrest 12 to rotate upwardly on the upper axle 11*b* on one hand, and causing the second link member 11 to be fitted into the first link member 9 in a telescopic relationship on the other. As a result, the support leg 15 formed essentially by the first and second link members collapses into a compact configuration. At this point of manipulation, the chair lift 24 is initiated into its downward movement to bring down the whole chair 7 into the storage recess 23 in the floor. As the chair lift 24 reaches its lowermost storage position, the cover 23*a* is moved to close the recess 23. It should be pointed out that the seat 13 and the backrest 14 may be brought into nesting relationship with one another by suitable means such as a sliding guide mechanism or guide wheels. Also, instead of lowering the lower pivot of the second link member with respect to the first link member, the lower pivot of the first link member may be brought upward with respect to the second link member in order to collapse the chair into a compact configuration.

Figure 9:
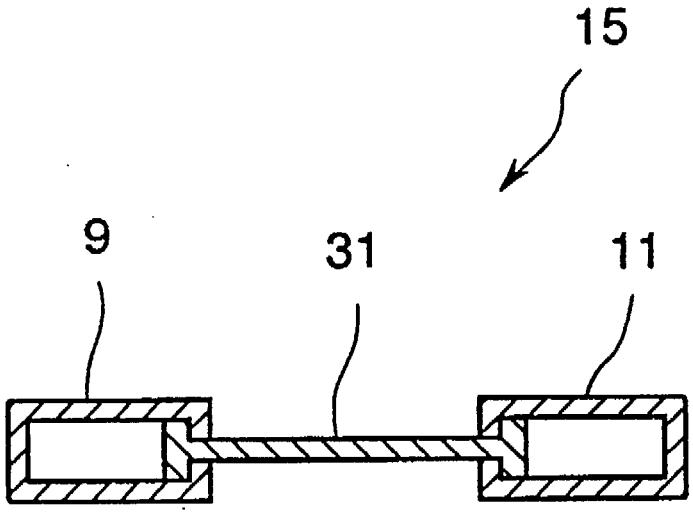
FIG. 9 is a horizontal cross-sectional view similar to FIG. 6 showing the support leg of a chair according to still another embodiment of the invention.

Although, in the above modified form of the invention, only the first and second link members constitute the leg collapsible widthwise, an additional component part may be employed as shown in FIG. 9. The support leg 15 of FIG. 9 comprises the first and second link members 9 and 11, both of which have a generally U-shaped horizontal cross-section, and an interconnecting plate 31 engageably fitted into the link members for relative sliding movement. The first and second link members 9 and 11 are interconnected by the plate 31 so that their relative movement may effectively reduce the overall configuration or size of the support leg 15. In lieu of the interconnecting plate 31, resilient cloth or accordion fold means may suitably be used to connect the first and second link members together. Alternatively, a space may be provided between the first and second link members.

Although the link members are explained hereinabove as being of different length, they may have an equal length. As for the backrest, it may suitably be designed to rotate through a limited angle with respect to the second link member.

While several preferred embodiments of the invention have been described in detail hereinabove, such description is for illustrative purposes only, and it is to be understood that changes and modifications may be made without departing from the spirit or scope of the invention.

POSSIBLE APPLICATIONS IN INDUSTRY

From the foregoing description, it is seen that the chair constructed according to the invention is particularly advantageous for installation on a movable bleacher stand where it is required that the chairs have a weighty and sturdy outer appearance in use and, at the same time, are capable of being reduced into a compact configuration for storage when not in use.

We claim:

1. A foldable chair comprising a support base member; a pair of legs each comprising a first link member pivotally movable with respect to the base member and a second link member mounted behind and in parallel to said first link member for pivotal movement with respect to said base member; an armrest pivotally mounted to an upper end of each of said first and second link members; a seat pivotally supported at each of its opposite sides by said first link member; a backrest pivotally supported at each of its opposite sides by said second link member; and said first link member being composed of a channel member having a longitudinal groove open toward said second link member; and said second link member being composed of a plate-like member having a forward longitudinal edge portion slidably engageable in said groove of said first link member, whereby said first and second link members make each said leg collapsible.

2. The foldable chair according to claim 1, wherein said support base member is mounted on a floor of a bleacher stand movable between an extended position for use and a retracted position for storage, and said first and second link members are pivotable between a position where said chair stands upright for use on the floor and a position where said chair is folded lying flat on the floor.

3. The foldable chair according to claim 1, wherein said support base member is mounted on lifting means for moving said chair between a position for use on a floor and a position for storage under the floor, and said first and second link members are designed so that relative positions of lower pivot points of said first and second link members can be changed.

* * * * *